United States Patent [19]

O'Keefe

[11] 4,143,604

[45] Mar. 13, 1979

[54] ADJUSTABLE GUIDE DEVICES

[75] Inventor: Michael O'Keefe, Barnsley, England

[73] Assignee: S. R. Gent and Company Limited, Great Britain

[21] Appl. No.: 870,244

[22] Filed: Jan. 17, 1978

[30] Foreign Application Priority Data

Jan. 14, 1977 [GB] United Kingdom ..... 1814/77

[51] Int. Cl.[2] ..... D05B 35/10

[52] U.S. Cl. ..... 112/152

[58] Field of Search ..... 112/136, 152, 153, 150, 112/51, 52; 270/93

[56] References Cited

U.S. PATENT DOCUMENTS

| | | | |
|---|---|---|---|
| 49,031 | 7/1865 | Huston | 112/150 |
| 751,398 | 2/1904 | Hughes | 112/152 |
| 793,220 | 6/1905 | O'Neill | 270/93 |
| 968,346 | 8/1910 | Hamlin | 112/153 |
| 2,612,126 | 9/1952 | Newman | 112/153 |
| 3,897,943 | 8/1975 | Head et al. | 270/93 |

*Primary Examiner*—Ronald Feldbaum

*Attorney, Agent, or Firm*—Armstrong, Nikaido, Marmelstein & Kubovcik

[57] ABSTRACT

An adjustable guiding device for guiding tapes, ribbons, threads or the like to a working station of a sewing machine. The device comprises a rod, a number of thin guide elements adjustably mounted on the rod for movement in a direction transverse to the rod, and releasable locking means for locking the guide elements in any pre-determined adjusted position. Selected guide elements can be adjusted, upon release of the locking means, so as to define at least one guide passage having a predetermined profile corresponding to the width and depth of the material to be passed therethrough.

8 Claims, 4 Drawing Figures

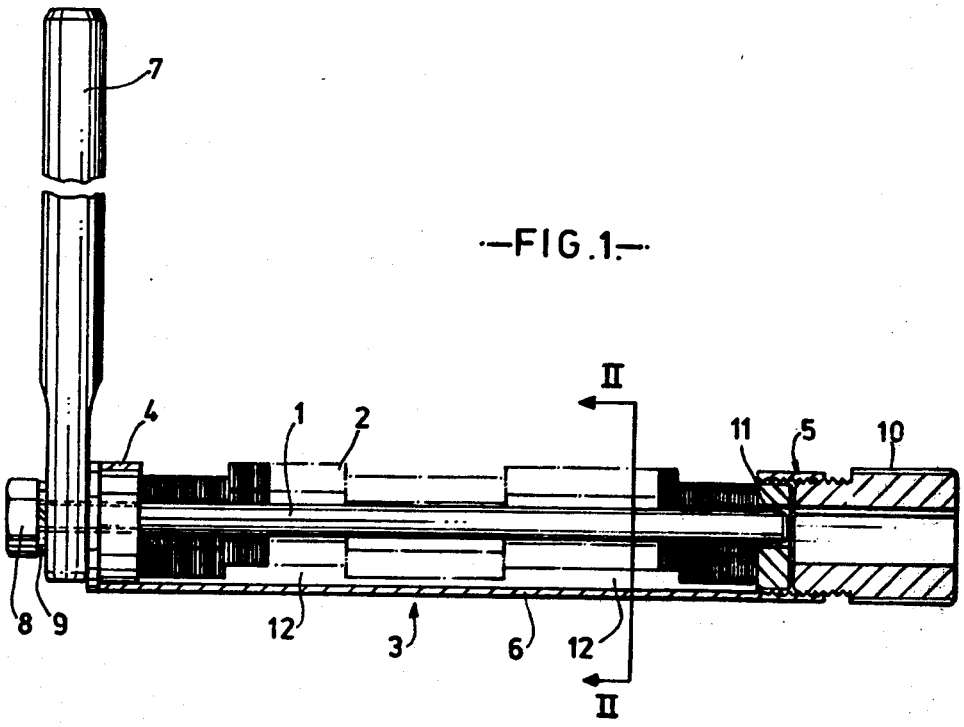
—FIG.1—
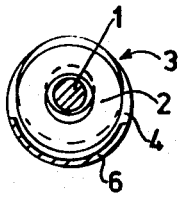
—FIG.2—
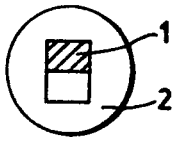
—FIG.3—

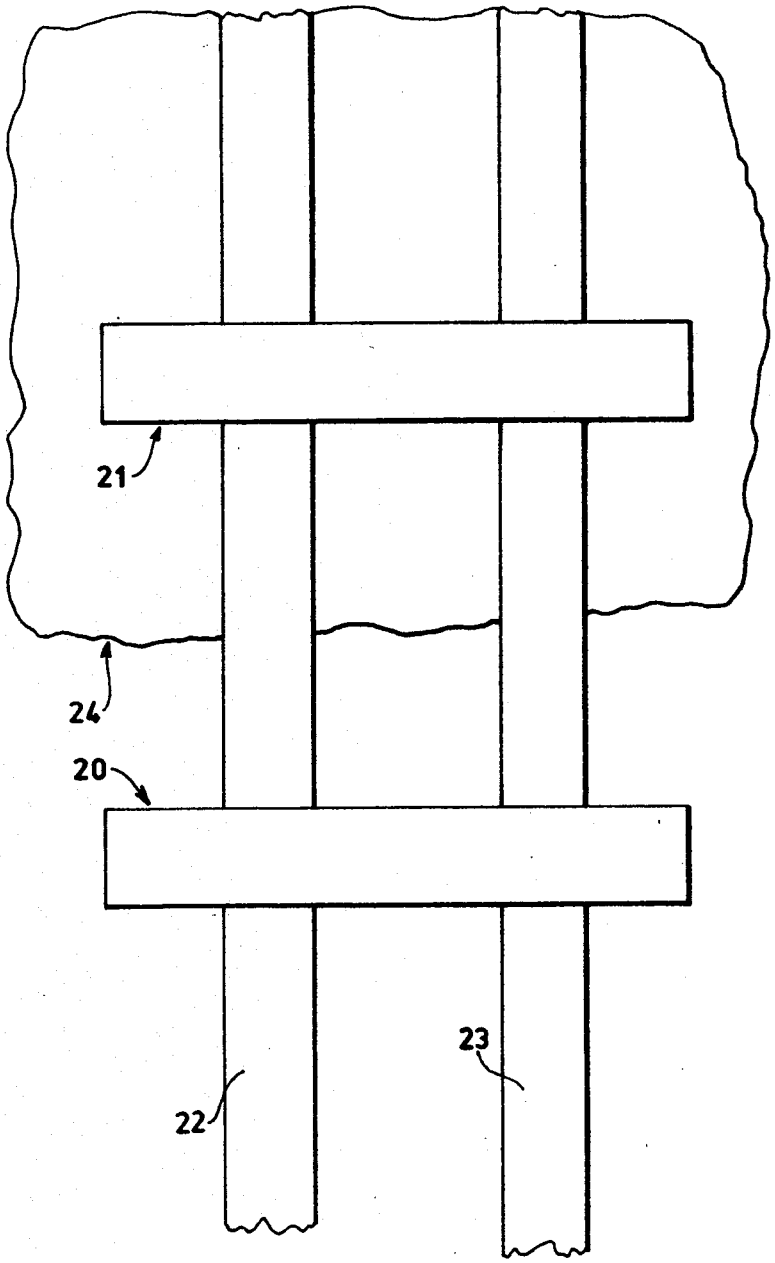
—FIG. 4.—

ADJUSTABLE GUIDE DEVICES

This invention relates to an adjustable guiding device, for example for use with a sewing machine, for guiding tapes, threads and other generally elongate material (referred to hereinafter as "material of the type specified").

It is known to provide guide devices for sewing machines for guiding tapes or like materials to the needle(s) of the machine. However, such guide devices are generally not adjustable and are only capable of guiding a single tape, and, if the size of the tape is changed, the guide must be removed and replaced by a fresh one. It is also known to provide an adjustable guide device which it is possible to adjust in respect of the width of the tape used. However, such a device is not adjustable in respect of the thickness of the tape and, when using delicate, thin tapes, for example of lace, the tape is liable to become jammed in the guide. In addition, the width of tapes tends to vary from one tape to another and a guide device which is suitable for one reel of tape may not be suitable for another reel of tape having nominally the same width.

It is an object of the invention to provide a guiding device which can be readily adjusted in order to provide a guide passage of a predetermined profile corresponding to the width and depth of any particular material required to be guided therethrough.

According to the invention, there is provided a guiding device for guiding material of the type specified to a working station and comprising:

an elongate member;

a plurality of thin guide elements each adjustably mounted on said elongate member for movement in a direction transverse to the elongate member whereby selected guide elements can be adjusted in order to define at least one guide passage having a predetermined profile corresponding to the width and depth of the material to be passed therethrough;

and releasable locking means operable when unlocked to allow adjustment of the guide elements to form a guide passage with a predetermined profile and, when locked, to maintain the predetermined profile of the guide passage.

BRIEF DESCRIPTION OF THE DRAWINGS

FIG. 1 shows, partly in section, an adjustable guide device according to the present invention;

FIG. 2 is a section along the line II—II in FIG. 1;

FIG. 3 is a sectional view of an alternative arrangement; and

FIG. 4 is a diagrammatic plan view of the guiding device mounted on a sewing machine to guide tapes or ribbons to a multi-needle head of the sewing machine.

DESCRIPTION OF PREFERRED EMBODIMENTS

FIGS. 1 and 2 show an adjustable guide device which comprises an elongate member in the form of a rod 1 of circular cross-section, and a multiplicity of plate members in the form of high precision washers 2 (forming thin guide elements) which have a central aperture which has a larger area than the cross-sectional area of the rod so that the washers are movable in a plane perpendicular to the axis of the rod. The washers 2 are located within a housing 3, which housing comprises a hollow cylindrical end member 4, 5 provided on either end of a part-cylindrical bridging member 6. One of the end members 4 is made in such a way that it fits relatively closely around the rod 1, whereas the other of the end members 5 has a hollow core which is dimensioned so that there is an annular space between the rod and the internal surface of the end member. The internal surface of the end member 5 is formed with a screwthread. The housing 3 is secured to the rod 1 by means of an allen screw (not shown) provided in the end member 4.

A supporting arm 7 for securing the device to a sewing machine (not shown), for example via a pivotable clamp is secured to the rod 1 adjacent to the end member 4 by means of a nut 8 and a spring washer 9. When the nut 8 is loosened, the housing 3 is pivotable in the aperture provided in the end of the supporting arm 7 and thus, by loosening and subsequently tightening the nut 8, the housing can be pivoted to and locked in any desired position so that the leading edge of the housing may apply controlled tension, if desired, to the material as it passes between the housing and the washers.

A locking member 10 engages with the thread of the end member 5 of the housing 3 and, when screwed into the end of the housing, serves to lock the washers together via a spacer member 11. The locking member 10 and the spacer member 11 are both hollow so as to permit the rod 1 to extend within them.

The device is set up by first unscrewing the locking member 10 to release the washers 2. The material such as a tape, ribbon or lace to be guided, or a piece of card, for example, of the same width and thickness as the material to be guided is then inserted between the housing and the washers and displaces a certain number of washers by a certain distance depending on the width and thickness of the material to form a guide passage 12 for the material. The locking member is then screwed up to lock the washers in position.

By using the adjustable guide device according to the present invention it is possible simultaneously to guide materials of different widths and of different thicknesses to a working station. To ensure the correct alignment of the material or materials to be guided, for example to ensure the correct alignment of the material or materials to the needles of a multi-needle sewing machine, the washers may be made or coated in various colours and interspaced as desired to suit the particular sewing machine needle gauge, for example the washers may be made of black NYLOTRON or black painted metal interspaced every quarter inch with a white washer. Alternatively, the guide device could be provided with a calibrated scale spanning its entire width e.g. on the barrel. The apertures in the washers and, for that matter, the cross-section of the rod may be other than circular, for example it may be advantageous to make the rod square and the apertures rectangular so that the washers are only displaced in one direction in the plane in which they are disposed (see FIG. 3).

In certain cases it may be possible to dispense with the housing and, for example when using a sewing machine, to run the material between the washers and the table on which the sewing machine is mounted. However, when using delicate materials such as lace this can be disadvantageous because the lace may get jammed between the table and the adjoining nonelevated washers, whereas when the housing is used the shape of the guide passage through which the material passes effectively prevents jamming.

The guide may also be used to guide individual threads.

The washers 2 may be circular in cross-section, as shown in the drawing, but other shapes may be employed e.g. triangular or sausage-shaped.

An alternative construction of locking means (not shown) for releasably locking the washers in position may be provided by forming an external screwthread on the projecting end of rod 1, and an internal screwthread in the locking member 10, and positioning a spacer member between the end of the member 10 and the adjacent end of the stack of washers 2.

FIG. 4 is a diagrammatic illustration of the guiding device of FIGS. 1 and 2, mounted on a sewing machine so as to guide ribbons, tape or other material to a multi-needle head thereof. In FIG. 4, references 20 and 21 designate the guiding device and the needle head respectively. By way of example only, tapes 22 and 23 are shown being guided at the required spacing by the guiding device 20 to the needle head 21, where the tapes are stitched to a piece of material 24. The sewing machine and the multi-needle head are of conventional construction and are therefore not described or illustrated in detail herein.

If desired, one or more additional guiding devices may be provided to cooperate with the needle head, being arranged on the sewing machine in the path of travel of the tapes or the like to the needle head.

I claim:

1. A guiding device for guiding material of the type specified to a working station and comprising:

an elongate member;

a plurality of thin guide elements each adjustably mounted on said elongate member for movement in a direction transverse to the elongate member whereby selected guide elements can be adjusted in order to define at least one guide passage having a predetermined profile corresponding to the width and depth of the material to be passed therethrough;

and releasable locking means operable when unlocked to allow adjustment of the guide elements to form a guide passage with a predetermined profile and, when locked, to maintain the predetermined profile of the guide passage.

2. A guiding device according to claim 1 in which the thin guide elements comprise plate members having apertures through which the elongate member is taken, the apertures being over-sized relative to the elongate member in order to allow transverse adjustment of the plate members.

3. A guiding device according to claim 2, in which the cross-section of the elongate member and the shape of the apertures in the plate members are selected so as to allow only relative unidirectional movement.

4. A guiding device according to claim 3, in which the elongate member has a square cross-section and said apertures are rectangular.

5. A guiding device according to claim 1, in which the elongate member and the guide elements are mounted in a housing which defines a part of a cylinder in the region of the material-guiding ends of the guide element to permit passage therebetween of said material of the type specified.

6. A guiding device according to claim 5, in which said housing is pivotally adjustable on said elongate member.

7. A guiding device according to claim 1 and mounted on a sewing machine having a needle head, said device being operable to guide said material of the type specified to said head.

8. A guiding device according to claim 7, in which the sewing machine has a multi-needle head, and spaced-apart blocks of said guide elements are coded to correspond to the respective needles of said needle head.

* * * * *